United States Patent [19]

Finch et al.

[11] Patent Number: 4,626,373

[45] Date of Patent: Dec. 2, 1986

[54] MANGANESE ADJUNCTS, THEIR PREPARATION AND USE

[75] Inventors: Timothy D. Finch, Bromborough; Raymond J. Wilde, Higher Bebington, both of Great Britain

[73] Assignee: Lever Brothers Company, New York, N.Y.

[21] Appl. No.: 668,536

[22] Filed: Nov. 5, 1984

[30] Foreign Application Priority Data

Nov. 8, 1983 [GB] United Kingdom ..... 8329762

[51] Int. Cl.[4] ..... C11D 9/42; D06L 3/00

[52] U.S. Cl. ..... 252/96; 252/90; 252/95; 252/99; 252/174.25; 252/186.1; 252/186.38; 252/186.41; 252/186.43; 502/324

[58] Field of Search ..... 252/186.1, 186.38, 186.41, 252/186.43, 90, 95, 99; 502/324

[56] References Cited

U.S. PATENT DOCUMENTS

| | | | |
|---|---|---|---|
| 3,156,654 | 11/1964 | Konecny et al. | 252/95 |
| 3,372,125 | 3/1968 | Hill et al. | 252/99 |
| 3,398,096 | 8/1968 | Das et al. | 252/95 |
| 3,532,634 | 10/1970 | Woods | 252/95 |
| 4,119,557 | 10/1978 | Postlethwaite | 252/99 |
| 4,208,295 | 6/1980 | Sai et al. | 252/94 |
| 4,481,129 | 11/1984 | Oakes | 252/186.41 |
| 4,536,183 | 8/1985 | Namnath | 8/107 |

FOREIGN PATENT DOCUMENTS

| | | |
|---|---|---|
| 25608 | 3/1981 | European Pat. Off. . |
| 57088 | 8/1982 | European Pat. Off. . |
| 82563 | 12/1982 | European Pat. Off. . |
| 72166 | 2/1983 | European Pat. Off. . |
| 47-51562 | 12/1972 | Japan . |
| 984459 | 2/1961 | United Kingdom . |

*Primary Examiner*—Paul Lieberman
*Assistant Examiner*—John F. McNally
*Attorney, Agent, or Firm*—Milton L. Honig; James J. Farrell

[57] ABSTRACT

A stable manganese adjunct for use as a bleach catalyst is obtained by having a manganese (II) cation bound to a "ligand" forming either a true complex compound, a water-insoluble salt compound, or an ion-binding compound by absorption, which compound is then protectively embedded in a matrix of water-soluble or water-dispersible material. The adjunct is particularly suitable for incorporation in fabric-washing powder compositions containing a peroxide bleach without causing instablity to the composition and brown discoloration due to $MnO_2$ formation.

16 Claims, 6 Drawing Figures

%
100
80
60
40
20
2
4
6
8
10
I
II
III
IV

%
100
80
60
40
20
2
4
6
8
10
I
II

% 100
80
60
40
20
0
2
4
6
8
10
II
I

% 100
80
60
40
20
0
2
4
6
8
10
II
I

% 100
80
60
40
20
0
2
4
6
8
10
I
I

% 100
80
60
40
20
0
2
4
6
8
10
II
I

MANGANESE ADJUNCTS, THEIR PREPARATION AND USE

This invention relates to stable manganese adjuncts for use as a bleach catalyst, and to solid particulate bleaching and/or detergent compositions comprising said adjuncts.

In U.S. Pat. No. 3,156,654 and European Patent Application No. 72166 there is disclosed that heavy metals not only catalyse peroxide decomposition but can also act under certain conditions to enhance the oxidising/-bleaching activity of peroxide bleaching agents.

In European Patent Application No. 0 082 563 there are described the outstanding properties of manganese as a bleach catalyst and its advantageous use in low to medium temperature bleaching and detergent compositions containing a carbonate builder.

Catalytic heavy metal cations, when incorporated in bleaching and detergent compositions in conjunction with a peroxide bleaching agent, tend to cause bleach loss during storage due to possible catalyst/bleach interaction.

From internal experiments it has been established that in the case of manganese two problems can occur on storage as a result of manganese incorporation in fabric-washing powder compositions containing a peroxide bleaching agent, i.e.:

(i) the interaction between manganese and the peroxide bleach, which results in rapid bleach decomposition during storage; and (ii) the formation of brown inactive manganese dioxide ($MnO_2$) in the pack during storage and/or upon powder dissolution, which can deposit on fabrics during the wash, giving unsightly brown stains.

In European Patent Application No. 0 072 166 it is proposed to pre-complex the catalytic heavy metal cation with a sequestrant and dry-mix it in particulate form with the remainder of the composition for improving composition storage stability. It is further stated that the complex of catalytic heavy metal cation and sequestrant can be agglomerated in a matrix of pyrophosphates, orthophosphates, acid orthophosphates and triphosphates.

Applicants have tested these methods and found none of them to be effective to overcome the above-mentioned problems connected with manganese incorporation in fabric-washing detergent compositions containing a peroxide bleach, especially when the detergent composition also comprises a carbonate builder, such as sodium carbonate.

The above techniques of the art are ineffective to solve both the instability problem and the manganese dioxide formation in the pack.

The procedure as described in EP No. 72166 has been copied with respect to manganese, i.e. spray-on of Mn/EDTA complex onto sodium triphosphate. As expected, this material was not storage-stable in a bleach-containing detergent composition. Brown spots accompanied by rapid bleach loss were observed after storage for only 3 days at 37° C./70% RH in a laminated carton pack.

It has now been found that a stable manganese adjunct which is particularly, but not exclusively, suitable and effective for use in carbonate built-detergent bleach compositions without causing the above-mentioned problems can be obtained by having a manganese (II) cation bound to a "ligand" forming either (1) a true complex compound, (2) a water-insoluble salt compound or (3) an ion-binding compound by adsorption, which compound is protectively enclosed in a matrix of water-soluble or water-dispersible material.

The "ligand"

(1) The "ligand" suitable for the purpose of the invention can be a water-soluble complexing agent which forms a strong complex with manganese. Examples of such water-soluble complexing agents are ethylenediamine tetraacetic acid (EDTA), diethylenetriamine pentaacetic acid (DETPA), nitrilotriacetic acid (NTA) and alkali metal and alkaline earth metal salts thereof; alkali metal triphosphates and alkali metal hexametaphosphates; ethylenediamine tetra (methylene phosphonic acid), diethylenetriamine penta (methylene phosphonic acid) and alkali metal and alkaline earth metal salts thereof; and polyelectrolytes such as polyacrylates and the copolymers of methylvinylether and maleic anhydride. Preferred "ligands" of this class are complexing agents which form complexes with stability constants greater than $10^{10}$, such as diethylene glycol tetraacetic acid, ethylene glycol tetraacetic acid, ethylene diamine tetraacetic acid (EDTA) and diethylene triamine pentaacetic acid (DETPA). (See "Stability constants of metal ion complexes", Chemical Society (London), Special Publication No. 17, 1964.)

(2) "Ligands" which form water-insoluble salts with manganese suitable for the purpose of the invention are for example the alkali metal pyrophosphates and long-chain fatty acids or their water-soluble soaps. Preferred "ligand" of this class is pyrophosphate.

(3) "Ligands" forming with manganese ion-binding compounds by adsorption, suitable for the purpose of the invention, are for example zeolites and other forms of sodium aluminosilicates, aluminium oxide ($AlO_3$), silica, aluminate surface-modified silica, clays, and other inorganic silicon- or aluminium-containing compounds.

Mixtures of "ligands" can also be used. Especially suitable are mixtures of zeolite and sodium tripolyphosphate.

The protective coating for forming the matrix

The protective coating for forming the matrix is a water-soluble or water-dispersible material and will generally have a melting point higher than 30° C., preferably higher than 40° C. Suitable protective coating materials may be selected from the group of organic homopolymers or heteropolymers, organic nonionic compounds, long-chain $C_{10}$–$C_{22}$ fatty acids and fatty acid soaps, and the so-called glassy sodium phosphates of the following molecular structure:

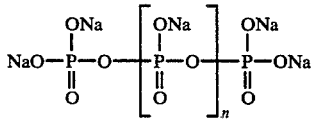

wherein the average value of n is from about 10 to 30.

Examples of suitable organic homo- or heteropolymers are modified starch, polyvinylpyrrolidone, polyvinylalcohol, and sodium carboxymethylcellulose.

Suitable nonionic compounds are for example polyethylene glycols having a molecular weight of from 1000 to 5000; $C_{15}$–$C_{24}$ fatty alcohols or $C_8$–$C_{12}$ alkylphenols having from about 10 to 60 ethylene oxide units; and the long-chain fatty acid alkylolamides, such as coconut fatty acid monoethanolamide.

The protective coating for forming the matrix of water-soluble or water-dispersible material can be applied by any suitable coating or encapsulation technique. As such can be named co-spray-drying; spray-cooling; extrusion; and any other granulation technique, for example by spraying a liquefied form of the water-soluble or water-dispersible material by melting or in aqueous dissolution onto a moving bed of manganese ligand compound particles, or by dispersing the manganese ligand compound particles in a solvent containing the protective coating material followed by solvent removal.

The material comprising the protective coating may not only be incorporated in the coating layer, but may also find use as a component of the core.

One of the problems that can be encountered during coating/encapsulation is agglomeration of the powder particles. It was considered that this problem could be overcome by absorbing an aqueous manganese complex solution (e.g. Mn/EDTA) on a porous support such as silica, zeolite or alumina. Coagulation of the adjunct particles during the subsequent coating step would thus be minimised, as the support would be capable of absorbing relatively large quantities of aqueous polymeric solutions or molten coatings. This technique will have the additional advantage of omitting the energy-expensive spray-drying step.

Accordingly, the invention provides a manganese adjunct which can be safely and stably used as a bleach catalyst in built detergent bleach compositions comprising peroxide bleaching agent without causing bleach instability problems and the formation of $MnO_2$ in the pack or upon powder dissolution, in which the adjunct comprises a manganese (II) cation bound to a "ligand" as a true complex, as a water-insoluble salt or as an ion-binding compound, protectively enclosed in a matrix of a water-soluble or water-dispersible material.

Advantageously the matrix of water-soluble or water-dispersible material forming the protective coating will comprise from about 5% to about 50%, preferably from about 30% to about 50% by weight of the adjunct.

A preferred "ligand" is a water-soluble complexing agent, highly preferred being those forming a particularly strong complex with manganese (II) having a stability constant of the Mn(II) complex greater than $10^7$, particularly greater than $10^{10}$ up to about $10^{16}$, such as ethylenediamine tetraacetic acid (EDTA) and diethylene triamine pentaacetic acid (DETPA). Another preferred "ligand" is zeolite.

Without wishing to be bound to any theory, it is believed that the need to complex or bind the manganese (II) cation with a suitable "ligand" is to prevent the release of $Mn(OH)_2 \rightarrow MnO_2$ in the dispenser.

A preferred protective coating material used for preparing the manganese adjunct of the invention is glassy sodium phosphate as hereinbefore defined, having an average value of n of about 10, which is also known as sodium hexametaphosphate or Graham's salt. This salt is, for example, commercially available under the trade name of Calgon ® supplied by Albright & Wilson.

Other preferred protective coatings are fatty acids and soaps.

As already explained before, the manganese adjunct of the present invention can be used as a peroxide bleach catalyst in any type of detergent compositions, especially in carbonate built detergent compositions.

Alternatively, the manganese adjunct of the invention may be presented in separate packages with or without a peroxide bleach and/or a carbonate-ion-producing compound, e.g. in unit sachets or "tea-bag"-type packages, for use as a bleach additive in fabric-washing processes.

Accordingly, in another aspect of the invention a detergent bleaching composition is provided comprising from 2 to 99.95% by weight of a peroxide bleaching agent and a manganese adjunct as hereinbefore described in an amount such that the composition contains from 0.005% to 5% by weight of manganese (II) cation.

The detergent bleach composition may further comprise a surface-active detergent material which may be anionic, nonionic, cationic or zwitterionic in nature or mixtures thereof, in an amount of from about 2 to 40% by weight of the composition.

Additionally, the composition may incorporate inorganic or organic detergency builders or mixtures thereof in amounts up to about 80% by weight, preferably from 1 to 60% by weight, and also other ingredients normally used in fabric-washing compositions, including other types of bleaches and bleach activators as desired.

A preferred detergent bleach composition will comprise a carbonate builder, a peroxide bleaching agent and a manganese adjunct as described hereinbefore. Examples of carbonate builders include sodium carbonate and calcite. Such compositions will normally comprise 1–50% by weight of a carbonate builder, 2–35% by weight of a peroxide bleaching agent an manganese adjunct in an amount of about 0.005–5% by weight expressed as $Mn^{2+}$.

Examples of peroxide bleaching agents include hydrogen peroxide adducts such as the alkali metal perborates, percarbonates, persilicates and perpyrophosphates, which liberate hydrogen peroxide in solution, the sodium salts being preferred.

EXAMPLE I

(1) Preparation of manganese/EDTA complex

To ensure complete complexation, a 2:1 molar excess of EDTA was used and the EDTA acid partially neutralized with sodium hydroxide, both to reduce the slurry moisture content to about 40% by weight and to impart rapid dissolution properties to the final complexed product. The process involved adding sodium hydroxide (6 moles) to an aqueous dispersion of EDTA acid (2 moles) in a stirred crutcher. The slurry moisture content at this point was 40% and the pH 8.5. A solution of manganous sulphate (1 mole) was then added and the whole was spray-dried to yield a white water-soluble powder containing about 6.0% by weight of $Mn^{2+}$.

In the same manner, manganese complexes were prepared with nitrilotriacetic acid (NTA), diethylene triamine pentaacetic acid (DETPA), diethylene triamine pentamethylene phosphonic acid (DETMP), ethylene diamine tetramethylene phosphonic acid (EDTMP) and trisodium nitrilotri(methylene)phosphonate.

To recover the product, further drying may be applied by e.g. freeze-drying or by rotary evaporation. Although complexation of manganese by this route avoids the risk of brown staining on dissolution, severe storage problems were encountered when the above complex was stored in carbonate-built detergent powder compositions containing a sodium percarbonate bleach. Complete bleach loss was observed after two weeks' storage in non-laminated packs at 37° C./70% RH (see FIG. 1), and moreover it was accompanied by oxidation of the EDTA and release of the manganese to form $MnO_2$.

In the absence of bleach the manganese complex is completely stable. Mn/EDTA has been stored in a base detergent formulation in an open beaker for 12 months at 37° C./70% RH without any apparent degradation.

FIG. 1 shows percarbonate bleach losses in sodium carbonate built detergent powder compositions with Mn/EDTA complex during storage conducted over 10 weeks at 37° C./70% RH (curve I) and 28° C./70% RH (curve II), as compared to control powders without manganese catalyst at 37° C./70% RH (curve III) and 28° C./70% RH (curve IV).

(2) Three different routes for protecting the manganese complex were tried (i) Spray-drying manganese/EDTA with an equal weight of a chemically modified encapsulant starch (ex National Starch Company - ref. 78-0048).

(ii) Dispersing the manganese/EDTA complex in a polyethylene glycol (MW 1500) noodle obtained by an extrusion technique, such that the ratio of complex to polyethylene glycol was 1:1.

(iii) Coating spray-dried Mn/EDTA complex with an aqueous 50% glassy sodium phosphate solution.

All three adjuncts dissolved readily in cold water and exhibited a manganese-catalysed bleaching effect. The results of storage trials, conducted over 10 weeks at 37° C./70% RH and 28° C./70% RH in non-laminated packs and polythene bags, showed that all three coating materials gave a considerable improvement in bleach-/composition stability over the unprotected controls.

Figure 1:
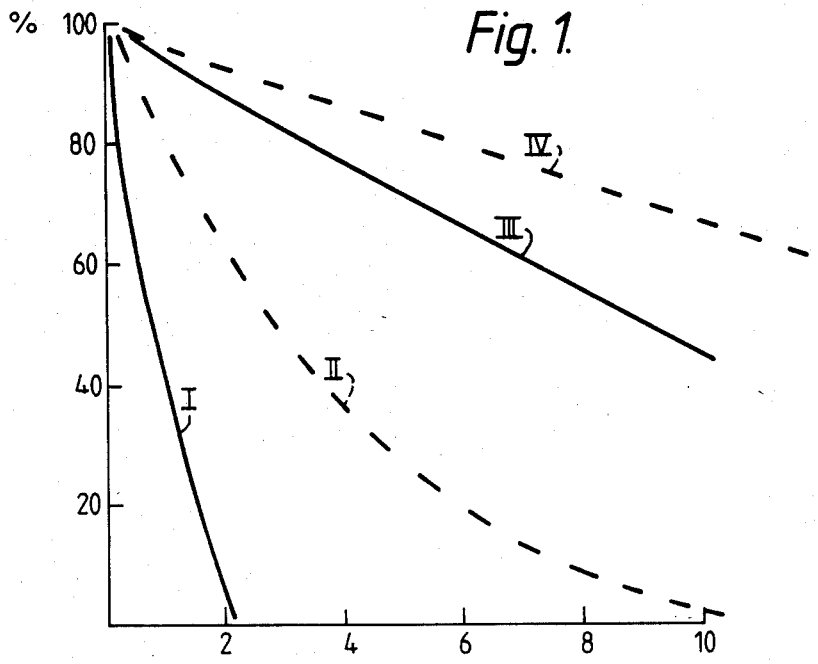
Figure 2:
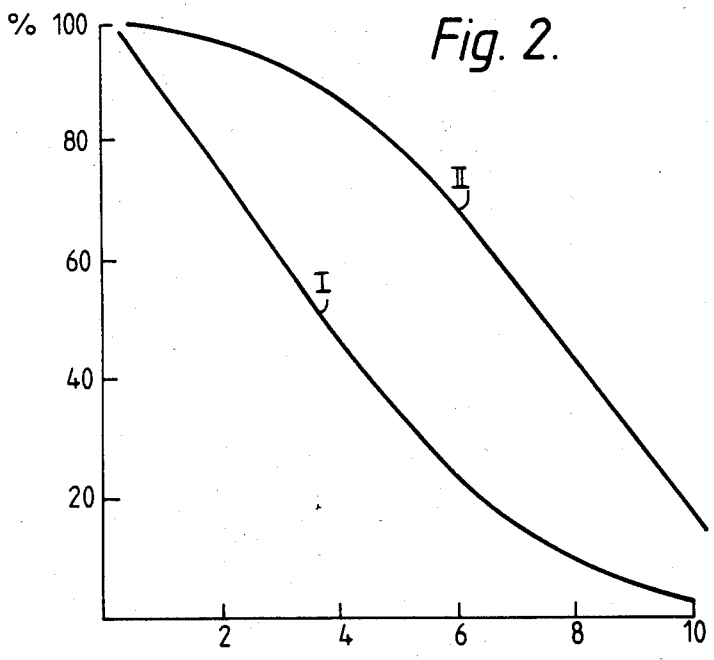
FIG. 2 shows sodium percarbonate bleach loss in a sodium carbonate built detergent powder containing manganese adjunct (i) stored in non-laminated packs (curve I) and polythene bags (curve II) conducted over 10 weeks at 37° C./70% RH.
Figure 3:
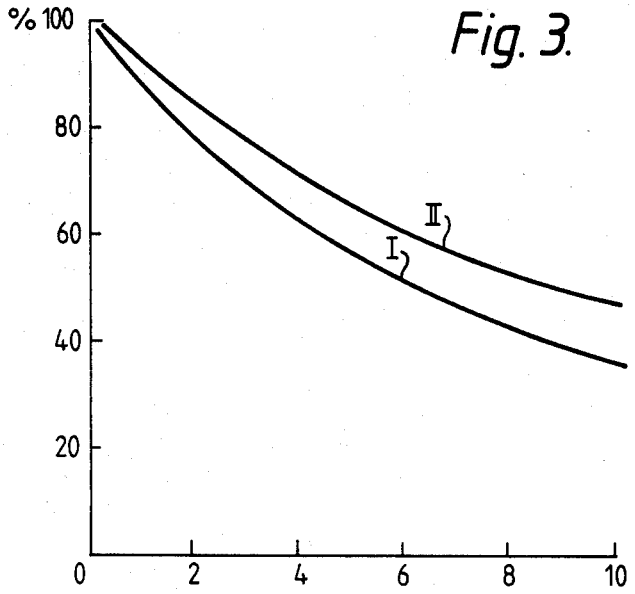
FIG. 3 shows the results of storage trials conducted with manganese adjunct (i) similar to FIG. 2, but at 28° C./70% RH; curve I in non-laminated packs and curve II in polythene bags.
Figure 4:
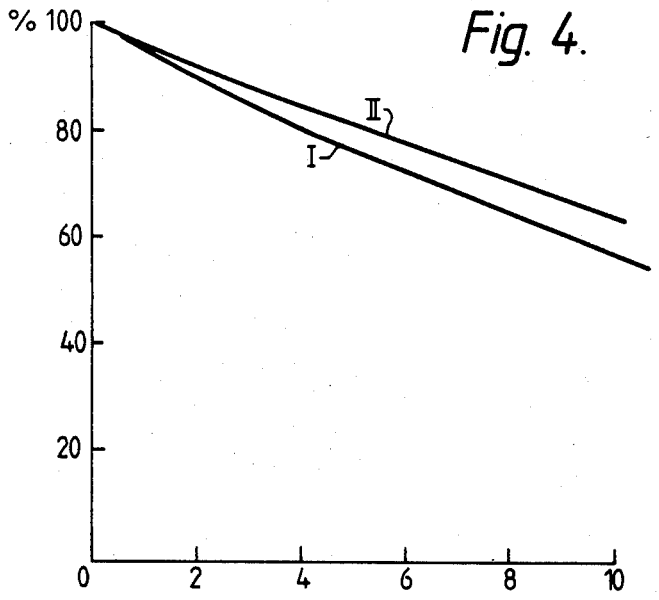
FIG. 4 shows sodium percarbonate bleach loss in a sodium carbonate built detergent powder containing manganese adjunct (ii) stored in non-laminated packs (curve I) and polythene bags (curve II) conducted over 10 weeks at 37° C./70% RH.
Figure 5:
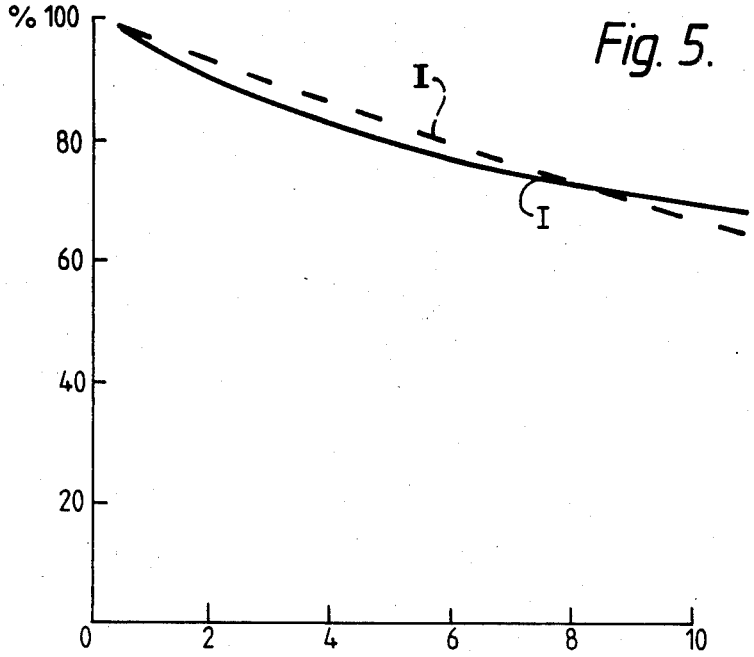
Figure 6:
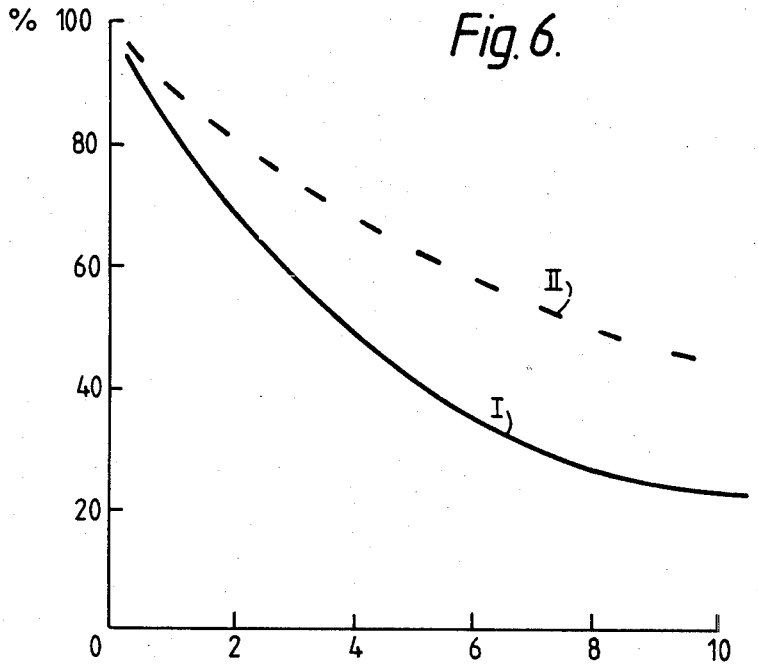

FIGS. 5 and 6 show the results of storage trials conducted over 10 weeks with sodium carbonate built detergent powders containing sodium percarbonate bleach and manganese adjunct obtained from process (iii) at 28° C./70% RH and 37° C./70% RH, respectively, compared with control compositions without manganese catalyst. (Curves I for compositions+manganese adjunct; curves II for control compositions without manganese catalyst).

Storage trials with the manganese adjunct obtained from process (iii) showed that sodium percarbonate losses were very little if any more than with a manganese-free control formulation at 28° C./70% RH (see FIG. 5). In addition, no $MnO_2$ was observed even after ten weeks at 37° C./70% RH in a non-laminated carton.

EXAMPLE II

Preparation of the glassy sodium phosphate coated adjunct

The manganese/EDTA complex of Example I(1) was dried to a moisture content of less than 1% in an oven at 135° C. The original moisture level of the spray-dried material varied from batch to batch and ranged from 0.8% to 6%. The complex (60 g) was intimately mixed for 20–30 minutes in a rotating drum with 10 g of a fine grade of silica (Gasil® HPV ex Crosfields), which had a particle size of <75 microns. The resultant powder was transferred to a polyethylene beaker (2 litres), and covered with a sealing film layer to prevent adjunct loss during coating.

A solution of sodium hexametaphosphate (15 g in 25 ml of demineralised water) was sprayed onto the powder from a pressurised Humbrol® paint sprayer, through a 4 cm diameter hole in the centre of the film. The beaker was rotated during this operation so that a thin continuous curtain of powder was always presented to the atomised glassy sodium phosphate solution.

After coating, the product was spread out evenly on a flat tray and allowed to to air-dry and harden up over a period of four days. Coarse particles were removed after this period on a 1700 μm sieve. The final product had a moisture content of about 10% and contained about 4% manganese.

Experimental evidence to date suggests that it is important not to heat the particles during coating or drying steps, as this could lead to increased perturbation of the outer layer and consequently to poor storage characteristics. The fine grade silica acts as a water sink and thus prevents excessive agglomeration of the complex particles during coating.

EXAMPLE III

Other suitable protective coating methods for preparing the adjunct (a) Manganese/EDTA complex was coated with a 50% sodium hexametaphosphate solution in a pan-granulator. The sodium hexametaphosphate level was 5% on the adjunct.

(b) Also in a pan-granulator:

| | parts by weight |
|---|---|
| Mn/EDTA complex | 60 |
| Calgon ® PT (ex Albright & Wilson) | 15 |
| fine grade silica (Gasil HPV) | 10 |
| water | 25 |

The Calgon PT and water were sprayed onto the Mn/EDTA complex and Gasil HPV mixture.

(c) Calgon was mixed with Mn/EDTA complex in a pan-granulator, onto which mixture a Calgon solution was sprayed.

(d) Calgon was added to the Mn/EDTA slurry and spray-cooled to give a partially coated complex, which was then coated finally with polyvinylpyrrolidone or more Calgon.

EXAMPLE IV

Manganese adjuncts were prepared from the following manganese/"ligand" combinations provided with different coating materials.

(1) manganese-EDTA (1:2) as prepared in Example I(1)

(2) manganese-DETPA (1:2) as prepared in Example I(1)
(3) manganese-zeolite (4A type containing 1% $Mn^{2+}$)
(4) manganese-pyrophosphate
(5) manganese-laurate.

(3) Preparation of manganese-zeolite

The zeolite used was a 4A type and has an Al to Si ratio of 1:1 and an ion-exchange capacity of $3.5.10^{-3}$ moles of $Mn^{2+}$ per gram. 17.3 grams of the zeolite was dispersed in demineralised water (200 ml). The pH of this solution was reduced from 11 to pH 7.4 with dilute hydrochloric acid to avoid the formation of manganous hydroxide during the preparation. The required level of manganous sulphate solution was added with stirring and allowed to equilibrate for 30 minutes. (2.7 g $MgSO_4.4H_2O$ is required for 20% occupancy of the available sites.) The manganese-zeolite was filtered under vacuum and washed with demineralised water before drying in an oven at 80° C. for 24 hours. The manganese-zeolite was white in colour and unchanged in appearance from the original zeolite material.

(4) Preparation of manganese-pyrophosphate

An aqueous solution of manganous sulphate tetrahydrate (22.3 g; 0.1 moles) was added with stirring to a solution of tetrasodium pyrophosphate decahydrate (22.3 g; 0.05 moles in 200 ml of demineralised water. The resultant fine white precipitate was filtered under vacuum and washed with acetone. The crude pyrophosphate (15.6 g; 92.3% yield) was dispersed in demineralised water and heated to boiling point. This solution was then filtered hot so that the water-soluble sodium sulphate impurity would be removed in the filtrate. The yield of manganous pyrophosphate after oven drying was 14.7 g (87%). Analysis indicated that the product was $Mn_2P_2O_7.3H_2O$.

(5) Preparation of manganese-laurate

An aqueous solution of $MnSO_4.4H_2O$ ($5\times10^{-3}$ molar) was added to a solution of sodium laurate ($1.2\times10^{-2}$ molar). The white precipitate formed on addition was filtered under vacuum, and washed with demineralised water and finally with acetone.

Three coating materials were used: (i) a soap, based on a 70/30 lauric/oleic fatty acid mix; (ii) hardened tallow fatty acid (HTFA) and (iii) coconut fatty acid ethanolamide (CEA).

All three coatings were applied in a similar manner. The manganese source (1)-(5) was dispersed in an organic solvent containing either soap, HTFA or CEA. The solvent was then removed under reduced pressure using a rotary evaporator, leaving a dry white granular powder with a nominal coating to inner core ratio of about 30:70.

Coating of manganese-EDTA with soap 98 g of manganese-EDTA granules (1) having an average particle size of 250 μm were dispersed in a solution of isopropyl alcohol/water (95:5) (300 ml) and soap (42 g). The solvent was removed under reduced pressure on a rotary evaporator, leaving soap-coated Mn/EDTA. The final traces of IPA/water were co-distilled with a small amount of acetone (100 ml).

Coating of manganese-zeolite with HTFA 140 g of manganese-zeolite (3) containing approximately 1% manganese was dispersed in petroleum ether, hexane fraction, (300 ml) and hardened tallow fatty acid (60 g). The hexane was removed under vacuum with a rotary evaporator. The last traces of hexane were again co-distilled with acetone, leaving a dry white powder. Care was taken during the distillation step to ensure that the melting point of the fatty acid (~56° C.) was not exceeded.

Coating of manganese-EDTA with CEA 98 g of manganese EDTA granules (1) having an average particle size of 250 μm were dispersed in a solution of CEA (42 g) in isopropyl alcohol (300 ml). The solvent was removed under reduced pressure on a rotary evaporator, leaving CEA-coated Mn/EDTA. The final traces of IPA were co-distilled with a small amount (100 ml) of acetone.

EXAMPLE V

The storage stability of the adjuncts of Example V was assessed in two product formulations (A) and (B). The rate of bleach (sodium perborate monohydrate) decomposition was monitored over a period of two months, and compared with a manganese-free control. The products were stored at 37° C./70% RH and 28° C./70% RH in small (56 g) wax-laminated cartons. (The water vapour transmission rate for these cartons at 25° C. and 75% RH was 37 g/m²/hr.)

The results are shown in Tables 1-3.

TABLE 1

Stability of sodium perborate monohydrate in a carbonate base formulation (A). Conditions: 28° C./70% RH; wax-laminated cartons.

| Manganese adjunct | | % perborate remaining after | |
|---|---|---|---|
| Mn source | Coating | 5 weeks | 8 weeks |
| None | — | 100 | 98 |
| $MnP_2O_7$ | HTFA | 94.3 | 83.0 |
| Mn—zeolite | HTFA | 79.2 | 52.2 |
| Mn—laurate | HTFA | 70.7 | 62.0 |
| Mn—DETPA | HTFA | 70.2 | 45.7 |
| Mn—EDTA | soap | 100 | no test |
| Mn—EDTA | none | <1 | 0 |

TABLE 2

Stability of perborate monohydrate in a carbonate base formulation (A). Conditions: 37° C./70% RH; wax-laminated carton.

| Manganese adjunct | | % perborate remaining after | |
|---|---|---|---|
| Mn source | Coating | 5 weeks | 8 weeks |
| None | — | 99.2 | 92.8 |
| $MnP_2O_7$ | HTFA | 75.4 | 60.5 |
| Mn—zeolite | HTFA | 79.2 | 25.3 |
| Mn—laurate | HTFA | 74.4 | 60.2 |
| Mn—DETPA | HTFA | 70.3 | 40.4 |
| Mn—EDTA | soap | 97.0 | no test |
| Mn—EDTA | none | <1 | 0 |

TABLE 3

Stability of perborate monohydrate in product formulation (B). Conditions: four weeks at 37° C./70% RH and 28° C./70% RH, in wax laminated cartons.

| Manganese adjunct | | % perborate remaining after 4 weeks | |
|---|---|---|---|
| Mn source | Coating | 28° C./70% RH | 37° C./70% RH |
| None | — | 100 | 91 |
| Mn—zeolite | soap | 87 | 93 |
| Mn—zeolite | HTFA | 90 | 70 |
| Mn—EDTA | soap | 100 | 97 |
| Mn—EDTA | CEA | 100 | 66 |

TABLE 3-continued

Stability of perborate monohydrate in product formulation (B). Conditions: four weeks at 37° C./70% RH and 28° C./70% RH, in wax laminated cartons.

| Manganese adjunct | | % perborate remaining after 4 weeks | |
|---|---|---|---|
| Mn source | Coating | 28° C./70% RH | 37° C./70% RH |
| Mn—zeolite | none | 17 | 0 |

Examination of the products described in Tables 1–3 after storage did not reveal any powder discolouration, or darkening of the adjunct particles, except in the cases of the uncoated Mn/EDTA and manganese-zeolites. The manganese-EDTA had turned dark brown/black during storage, whilst the whole zeolite-containing powder agglomerated together and was light brown in colour.

Optimisation studies indicated that a coating level of 30% by weight was near the lower limit for the organic coating material used in the tests. Reduction of the soap level to 25% on a manganese-EDTA support resulted in a 66% loss of perborate after 4 weeks at 28° C./70% RH, whereas a 50% coating gave perfect protection under the same conditions (see Tables 1, 2 and 3).

EXAMPLE VI

Bleaching experiments were carried out with powder formulations (A), (B) and (C) containing manganese adjuncts of Example V, in a Tergotometer isothermal wash at 25° C., using water of 15° French hardness and a product concentration of 6 g/l.

Powder formulations without manganese adjunct and with a non-coated manganese adjunct were used for comparison.

The results are shown in the following Tables 4–6.

TABLE 4

Bleaching of standard tea-stained test cotton with powder formulation (A) expressed as $\Delta R_{460*}$ (reflectance). The manganese adjunct was added at 2 ppm $Mn^{2+}$ in solution.

| Manganese adjunct | | Wash Period | |
|---|---|---|---|
| Mn source | coating | 20 minutes | 40 minutes |
| none | — | 2.8 | 6.7 |
| Mn—EDTA | none | 9.2 | 16.0 |
| Mn—EDTA | HTFA | 9.7 | 16.6 |
| Mn—EDTA | soap | 8.5 | 15.9 |

TABLE 5

Bleaching of standard tea-stained test cotton with powder formulation (B), expressed as $\Delta R_{460*}$ (reflectance). The manganese adjunct was added at 5 ppm $Mn^{2+}$ in solution.

| Manganese adjunct | | Wash Period | |
|---|---|---|---|
| Mn source | coating | 20 minutes | 40 minutes |
| none | — | 0.8 | 1.2 |
| Mn—zeolite | HTFA | 1.5 | 6.2 |
| Mn—zeolite | soap | 3.6 | 9.9 |

TABLE 6

Bleaching of standard tea-stained test cotton with powder formulation (C), expressed as $\Delta R_{460*}$ (reflectance). The manganese adjunct was added at 2 ppm $Mn^{2+}$ in solution.

| Manganese adjunct | | Wash Period | |
|---|---|---|---|
| Mn source | coating | 20 minutes | 40 minutes |
| none | — | 3.5 | 7.7 |
| Mn—zeolite | soap | 11.9 | 17.4 |

TABLE 6-continued

Bleaching of standard tea-stained test cotton with powder formulation (C), expressed as $\Delta R_{460*}$ (reflectance). The manganese adjunct was added at 2 ppm $Mn^{2+}$ in solution.

| Manganese adjunct | | Wash Period | |
|---|---|---|---|
| Mn source | coating | 20 minutes | 40 minutes |
| Mn—zeolite | HTFA | 11.1 | 15.1 |

The above results demonstrate that the presence of coating did not significantly affect the release of the $Mn^{2+}$ into the wash liquor. This is surprising, particularly for those adjuncts protected with hardened tallow fatty acid.

| Nominal composition (% by weight) of powder formulation: | A | B | C |
|---|---|---|---|
| Sodium dodecylbenzene sulphonate | 28.0 | 9.0 | 28.0 |
| Nonionic surfactant | — | 1.5 | — |
| Sodium soap | — | 0.5 | — |
| Sodium carbonate | 26.9 | 10.0 | 32.0 |
| Sodium triphosphate | — | 12.0 | — |
| Sodium orthophosphate | — | 13.5 | — |
| Alkaline silicate | 11.1 | 8.0 | 12.0 |
| Sodium bicarbonate | 4.8 | — | 5.0 |
| Sodium sulphate | 4.8 | 4.0 | 1.3 |
| Sodium carboxymethylcellulose | 0.8 | 0.5 | 1.0 |
| Fluorescer | 0.16 | 0.3 | 0.34 |
| EDTA | 0.2 | 0.1 | 0.2 |
| Sodium perborate monohydrate | 20.0 | 20.0 | 20.0 |
| Moisture | | up to 100% | |

EXAMPLES VII AND VIII

Other manganese adjuncts according to the invention were prepared:

(VII)—60 parts of Mn/EDTA complex were coated in a rotating beaker with a solution of polyvinyl pyrollidone (5.2 g; MW=60,000) in ethyl alcohol (12.5 ml). The polymer was applied by spraying from a pressurised "Humbrol ®" paint sprayer.

(VIII)—Manganese/EDTA complex was mixed with an equal weight of tallow alcohol/50 ethylene oxide condensate nonionic compound in a Beken ® mixer. The dough was then milled before being extruded through a gauze fitted at the end of a plodder.

We claim:

1. Manganese adjunct for use as a bleach catalyst comprising a manganese (II) cation bound to a ligand forming a compound selected from the group consisting of a true complex compound, a water-insoluble salt compound, an ion-binding compound by adsorption and mixtures thereof, said manganese (II)-ligand compound being present at least in an amount effective to catalyze bleaching, which compound is protectively embedded in a matrix of a water-soluble or water-dispersible material selected from the group of organic homopolymers or heteropolymers, organic nonionic compounds, long-chain $C_{10}$–$C_{22}$ fatty acids, long-chain $C_{10}$–$C_{22}$ fatty acid soaps, glassy sodium phosphates and mixtures thereof, said matrix present in an amount from 5 to 50% by weight of the manganese adjunct.

2. Manganese adjunct according to claim 1, wherein said ligand is a water-soluble complexing agent forming a complex with manganese (II) having a stability constant greater than $10^7$.

3. Manganese adjunct according to claim 2, wherein said water-soluble complexing agent forms a complex with manganese (II) having a stability constant greater than $10^{10}$ to $10^{16}$.

4. Manganese adjunct according to claim 2, wherein said complexing agent is selected from the group consisting of ethylene diamine tetraacetic acid, diethylene triamine pentaacetic acid, and alkali metal salts thereof.

5. Manganese adjunct according to claim 1, wherein said ligand is an alkali metal pyrophosphate.

6. Manganese adjunct according to claim 1, wherein said ligand is selected from zeolites and other forms of sodium aluminosilicates, aluminium oxide, silica, clays and aluminate surface-modified silica.

7. Manganese adjunct according to claim 1, wherein said protective coating material has a melting point higher than 30° C.

8. Manganese adjunct according to claim 7, wherein said protective coating material has a melting point higher than 40° C.

9. Manganese adjunct according to claim 11, wherein said matrix of water-soluble or water-dispersible material comprises from 30 to 50% by weight of the manganese adjunct.

10. A detergent bleach composition comprising from 2 to 99.95% by weight of a peroxide bleaching agent and 0.005 to 5% by weight of a manganese adjunct as a bleach catalyst comprising a manganese (II) cation bound to a ligand forming a compound selected from the group consisting of a true complex compound, a water-insoluble salt compound, an ion-binding compound by adsorption and mixtures thereof, said manganese (II)-ligand compound being present at least in an amount effective to catalyze bleaching, which compound is protectively embedded in a matrix of a water-soluble or water-dispersible material selected from the group consisting of organic homopolymers or heteropolymers, organic nonionic compounds, long-chain $C_{10}$–$C_{22}$ fatty acids, long-chain $C_{10}$–$C_{22}$ fatty acid soaps, glassy sodium phosphates and mixtures thereof, said matrix present in an amount from 5 to 50% by weight of the manganese adjunct.

11. A detergent bleach composition according to claim 10, comprising (a) 2–40% by weight of a surface-active agent selected from anionic, nonionic, cationic and zwitterionic surfactants and mixtures thereof;

(b) 1–60% by weight of a detergency builder;

(c) 1–50% by weight of a carbonate builder;

(d) 2–35% by weight of a peroxide bleaching agent; and (e) 0.005–5% by weight of manganese (II) in adjunct form.

12. A detergent bleach composition according to claim 10, wherein said manganese adjunct is formed from a manganese (II) cation bound to a ligand forming a true complex with manganese (II) having a stability constant greater than $10^7$.

13. A detergent bleach composition according to claim 10, wherein said manganese adjunct is formed from manganese (II) pyrophosphate.

14. A detergent bleach composition according to claim 10, wherein said manganese adjunct is formed from manganese-zeolite.

15. Manganese adjunct according to claim 1, wherein the protective matrix is polyvinylpyrrolidone or a modified starch.

16. A detergent composition according to claim 10, wherein the protective matrix is polyvinylpyrrolidone or a modified starch.

* * * * *